US011660485B2

(12) United States Patent
Swayze et al.

(10) Patent No.: US 11,660,485 B2
(45) Date of Patent: May 30, 2023

(54) FIRE SUPPRESSION SYSTEM

(71) Applicant: E-One, Inc., Ocala, FL (US)

(72) Inventors: Stephen B. Swayze, Hernando, FL (US); James Roger Lackore, Jr., Big Bend, WI (US)

(73) Assignee: E-One, Inc., Ocala, FL (US)

( * ) Notice: Subject to any disclaimer, the term of this patent is extended or adjusted under 35 U.S.C. 154(b) by 208 days.

(21) Appl. No.: 16/875,301

(22) Filed: May 15, 2020

(65) Prior Publication Data

US 2021/0353989 A1 Nov. 18, 2021

(51) Int. Cl.

| | |
|---|---|
| ***A62C 35/68*** | (2006.01) |
| ***A62C 99/00*** | (2010.01) |
| ***A62C 5/02*** | (2006.01) |

(52) U.S. Cl.

CPC ..... *A62C 99/0036* (2013.01); *A62C 5/02* (2013.01); *A62C 35/68* (2013.01)

(58) Field of Classification Search

CPC ..... A62C 5/00–027; A62C 35/68; A62C 99/0036; B05B 7/1468; B05B 7/2486; B05B 7/2472; B05B 7/0018–0068; B05B 14/00–49

See application file for complete search history.

(56) References Cited

U.S. PATENT DOCUMENTS

| | | | | |
|---|---|---|---|---|
| 5,004,155 | A * | 4/1991 | Dashevsky | B05B 7/32 417/427 |
| 5,240,078 | A | 8/1993 | Worthington | |
| 2005/0023006 | A1* | 2/2005 | Vonhof | A62C 5/02 169/44 |
| 2009/0134241 | A1* | 5/2009 | Hoffmann | B05B 9/0403 239/112 |
| 2018/0221697 | A1 | 8/2018 | Shively et al. | |
| 2020/0215372 | A1* | 7/2020 | LaVergne | A62D 1/0071 |

* cited by examiner

*Primary Examiner* — Tuongminh N Pham

(74) *Attorney, Agent, or Firm* — Michael Best & Friedrich LLP

(57) ABSTRACT

Systems and methods for fire suppression systems are disclosed. In one embodiment, the fire suppression system comprises a water supply system, a foam concentrate supply system, and a foam concentrate recovery system. The water supply system includes a water pump and a water supply line. The foam concentrate supply system includes a foam pump and a foam concentrate supply line, the foam concentrate supply line fluidly connected with the water supply system to facilitate mixing foam concentrate provided by the foam concentrate supply system with water provided by the water supply system. The foam concentrate recovery system includes a recovery pump fluidly connectable with the foam concentrate supply system to facilitate the extraction of foam concentrate from at least a portion of the foam concentrate supply system. The system and method can also include circulating foam concentrate to promote mixing and hinder the congealment of foam concentrate.

20 Claims, 10 Drawing Sheets

FIRE SUPPRESSION SYSTEM

BACKGROUND

The invention relates generally to fire suppression systems designed to produce a foam-water mixture out of a discharge outlet.

SUMMARY

In many modern firefighting systems, a mixture is formed by injecting and metering foam concentrate into a water stream. Such systems are commonly used for fire suppression in industrial applications to combat fires in oil refineries, chemical plants, and other large facilities where highly flammable liquid materials are processed or stored. These fires are often fought by blanketing the flammable material with Class B foam. After use of the foam system there remains a significant volume of foam concentrate in the lines of the system. This concentrate must be removed from within the lines. Many foam concentrates congeal as they set for long periods of time, especially if air is present. This can lead to damage of mechanical components if not removed from the lines.

Larger industrial firefighting systems can hold as much as 5 to 15 gallons of foam concentrate in their plumbing manifolds. To remove it from the system, the foam concentrate is typically flushed through the system and pumped out of a discharge where it could undesirably enter the environment. Foam concentrates are also relatively expensive, costing between $20 and $40 per gallon of concentrate depending on brand and chemical makeup.

In one aspect, the invention provides a fire suppression system comprising a water supply system, a foam concentrate supply system, and a foam concentrate recovery system. The foam concentrate supply system includes a pipe segment. The foam concentrate supply system is fluidly connected with the water supply system to facilitate mixing of foam concentrate provided by the foam concentrate supply system and passing through the pipe segment with water provided by the water supply system. The foam concentrate recovery system includes a recovery pump fluidly connectable with the pipe segment of the foam concentrate supply system to facilitate the extraction of foam concentrate from the pipe segment.

In another independent aspect, the invention provides a method of operating a fire suppression system. The method comprises supplying water through a water supply system, supplying foam concentrate through a foam concentrate supply system including a foam tank and a foam concentrate supply line in fluid communication with the water supply system, mixing the water and the foam concentrate to form a foam-water mixture, exhausting the foam-water mixture from the fire suppression system, and recovering at least a portion of the foam concentrate from the foam concentrate supply line to the foam tank.

Independent aspects of the invention will become apparent by consideration of the detailed description, claims and accompanying drawings.

DETAILED DESCRIPTION

Before any embodiments of the present invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
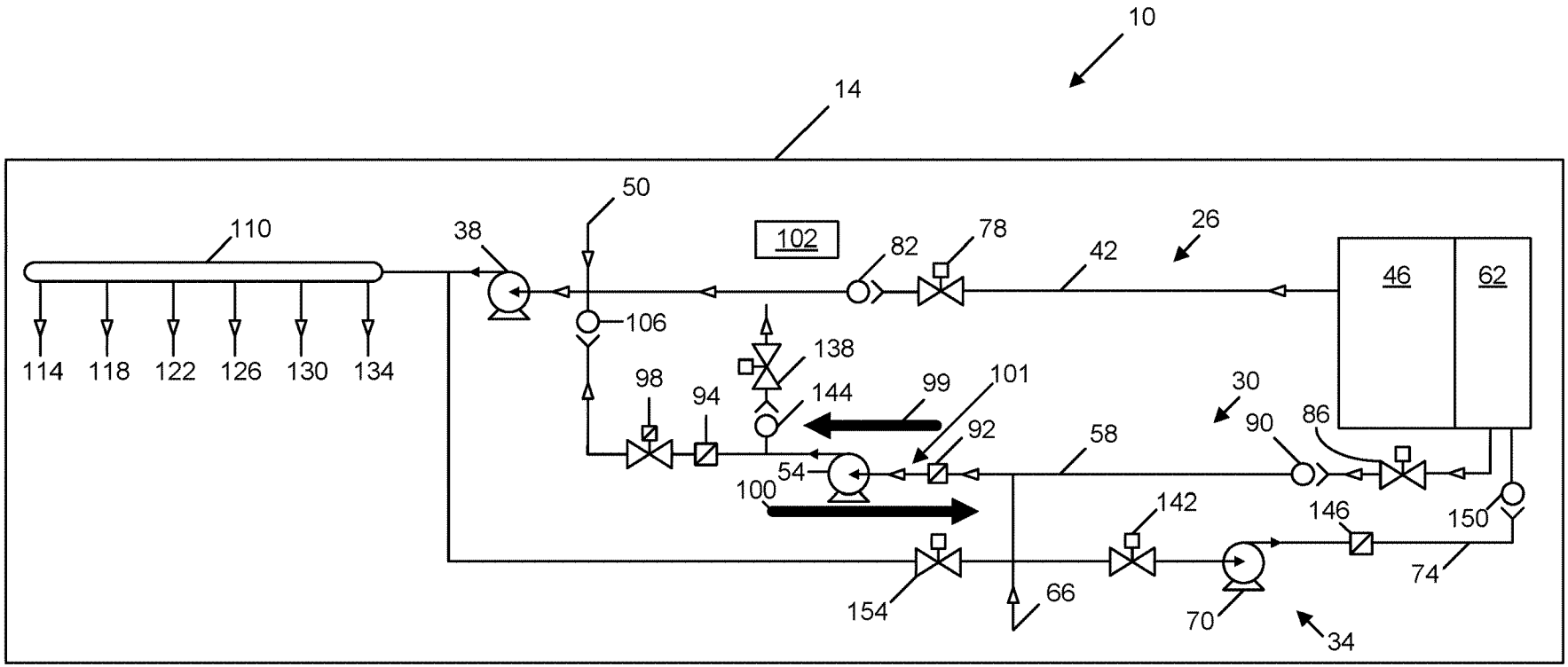
FIG. 1 is a schematic view of a fire suppression system with injection of foam concentrate upstream of a water pump.
Figure 6:
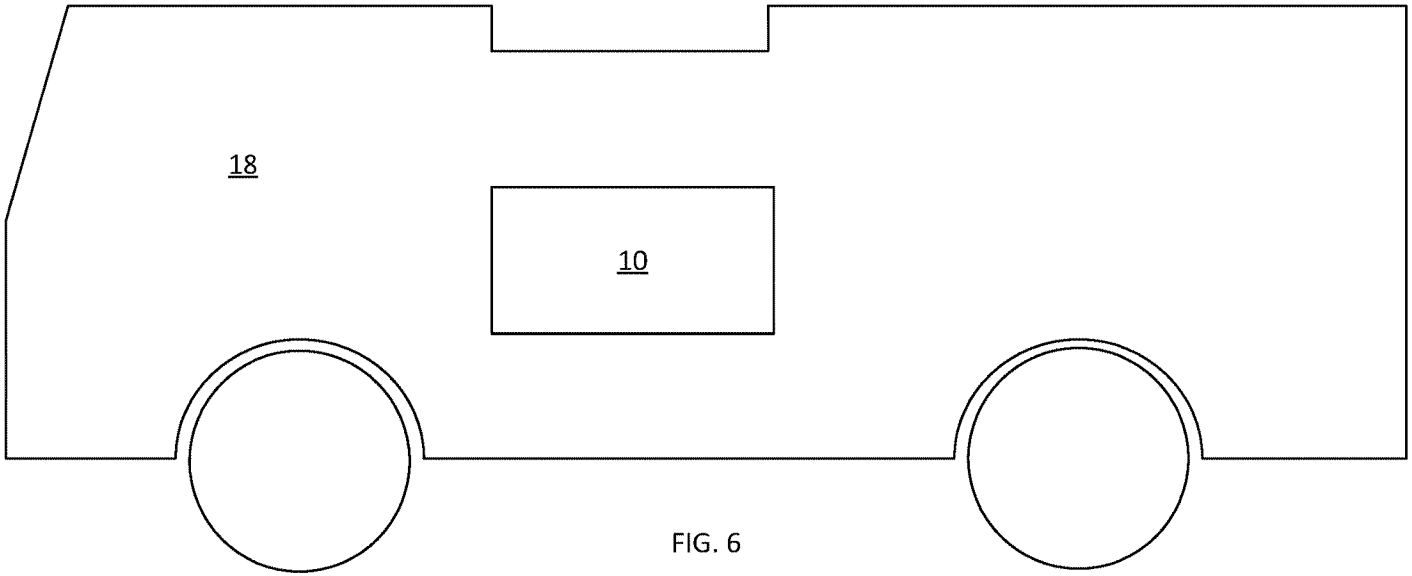
FIG. 6 is a schematic view of the fire suppression system of FIG. 1 as applied in a vehicle.
Figure 7:
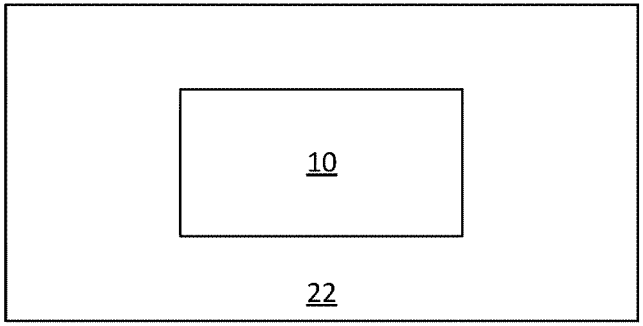
FIG. 7 is a schematic view of the fire suppression system of FIG. 1 as applied in a building.
Figure 8:
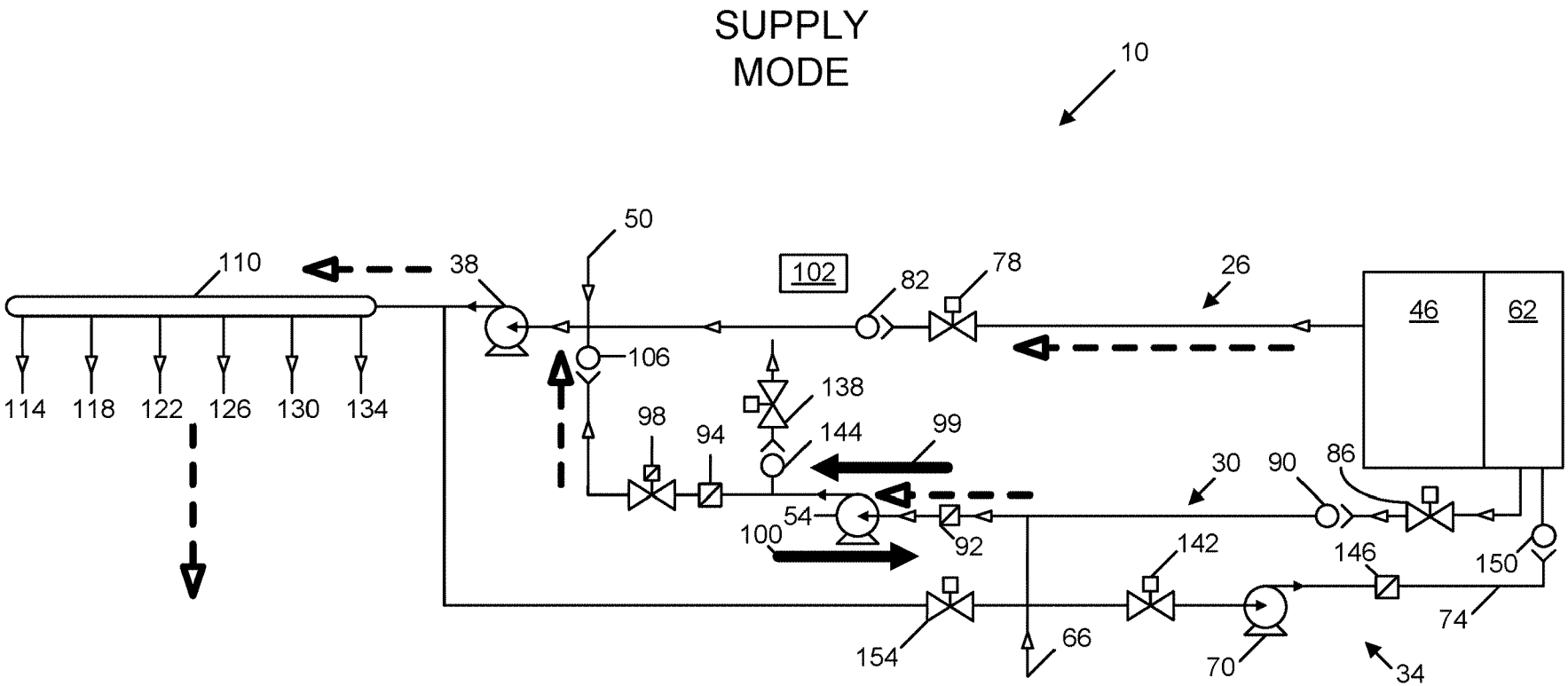
FIG. 8 is a schematic view of the fire suppression system of FIG. 1 in a supply mode and including arrows illustrating the flow of fluid.
Figure 9:
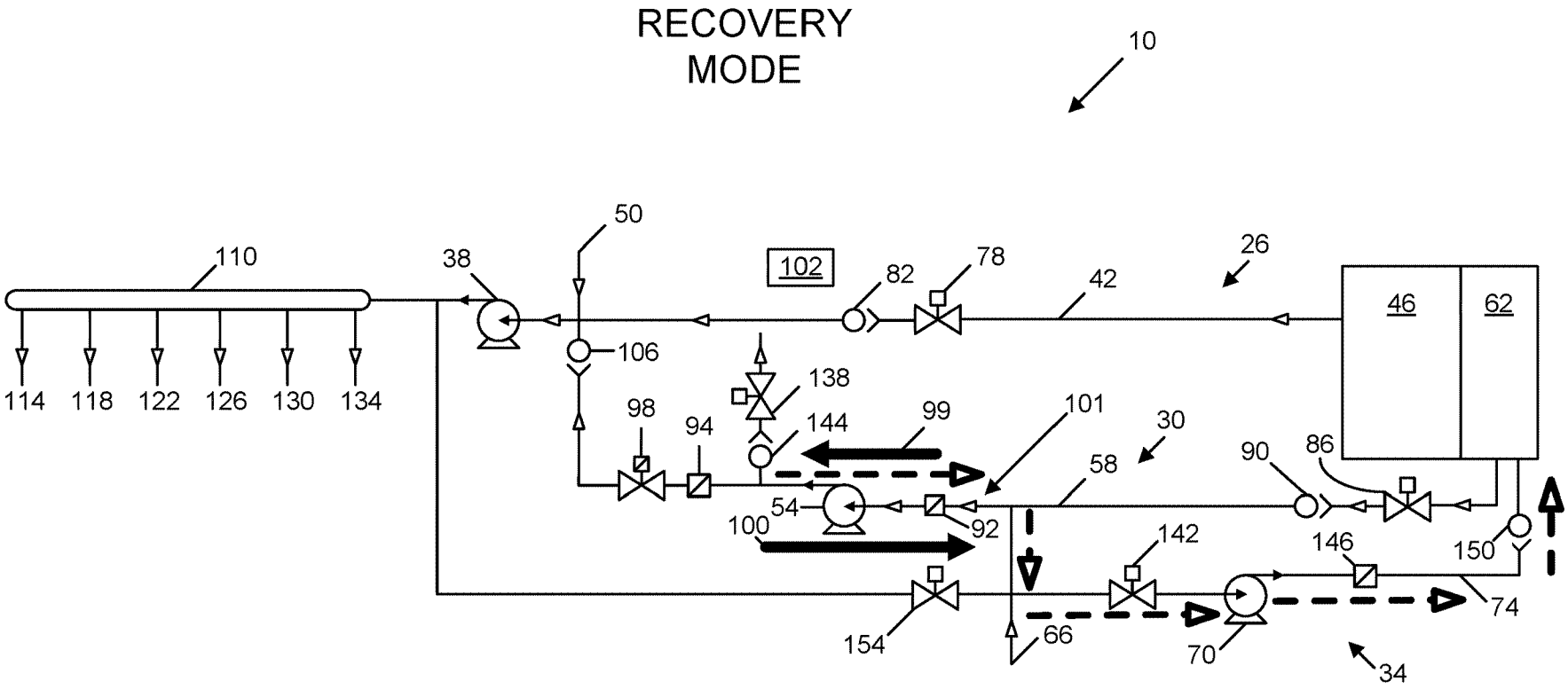
FIG. 9 is a schematic view of the fire suppression system of FIG. 1 in a recovery mode and including arrows illustrating the flow of fluid.
Figure 10:
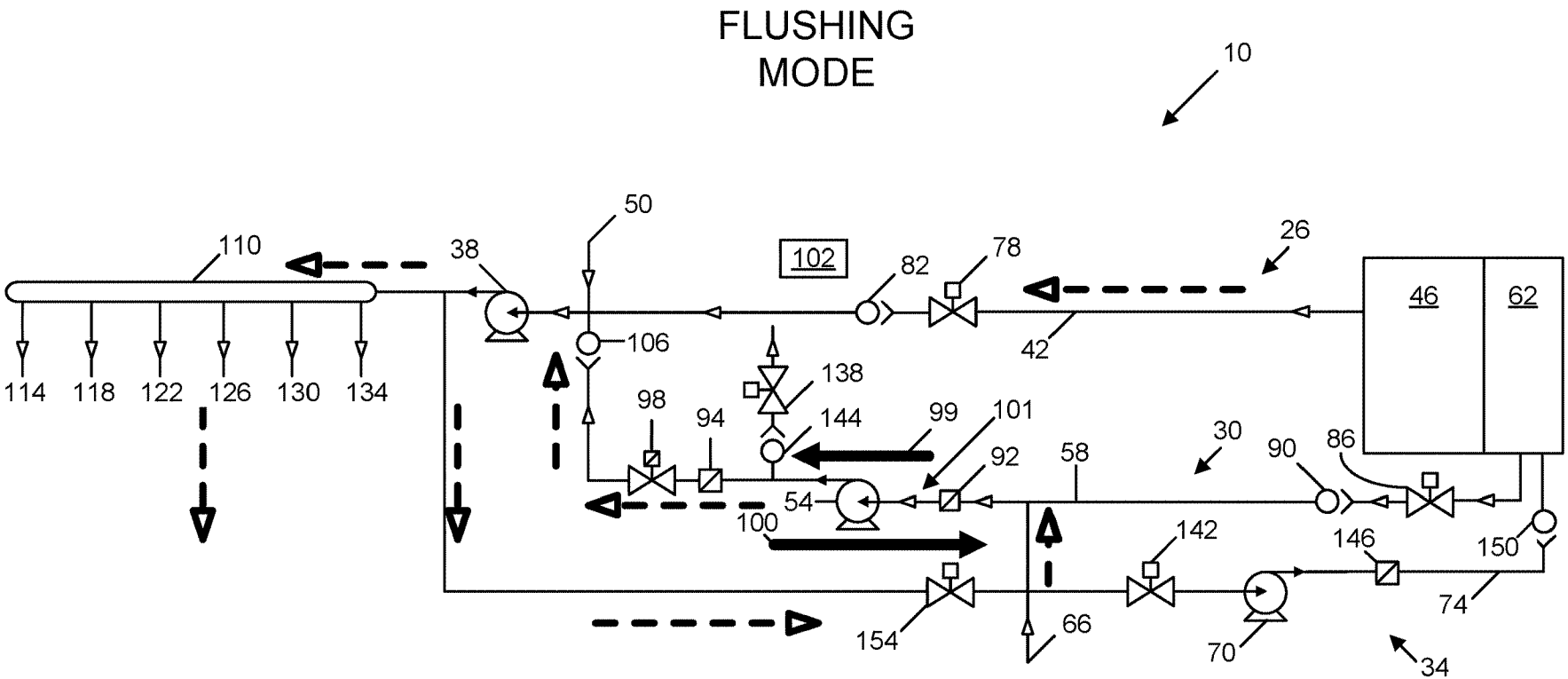
FIG. 10 is a schematic view of the fire suppression system of FIG. 1 in a flushing mode and including arrows illustrating the flow of fluid.

FIG. 1 illustrates a fire suppression system 10 capable of distributing a foam-water mixture in a supply mode, recovering a portion of residual foam concentrate from within the system 10 in a recovery mode, and flushing the remainder of residual foam concentrate from the system 10 in a flushing mode. Broadly speaking, the fire suppression system 10 shown in FIG. 1 is a simple form of the invention, while the embodiments of the system 10 shown in FIGS. 2-5 illustrate additional features of the invention. FIGS. 6 and 7 illustrate the system 10 as applied in an apparatus 14 such as a fire truck 18 and a building 22 respectively. Other applications of the system 10 are possible. FIGS. 8-10 illustrate the flow of fluid in the supply mode, recovery mode, and flushing mode, respectively, with regard to the fire suppression system 10 shown in FIG. 1.

FIG. 1 illustrates the fire suppression system 10 including a water supply system 26, a foam concentrate supply system 30, and a foam concentrate recovery system 34. The illustrated water supply system 26 includes a water pump 38 and a water supply line 42. The water supply line 42 receives water from at least one of a water tank 46 and an external water source 50.

The illustrated foam concentrate supply system 30 includes a foam pump 54 and a foam concentrate supply line 58. The foam concentrate supply system 30 receives foam concentrate from at least one of a foam tank 62 and an external foam source 66. The foam concentrate supply line 58 is fluidly connected with the water supply system 26 upstream of the water pump 38. This fluid connection facilitates mixing of foam concentrate provided by the foam concentrate supply system 30 with water provided by the water supply system 26.

The foam concentrate recovery system 34 includes a recovery pump 70 and a recovery line 74. The recovery line 74 fluidly couples the foam tank 62 to the foam concentrate supply system 30. This fluid connection facilitates the extraction of foam concentrate from at least a portion of the foam concentrate supply system 30 and the recovery of the foam concentrate to the foam tank 62.

With reference to FIGS. 1 and 8, the fire suppression system 10 distributes the foam-water mixture in the supply mode. In the illustrated supply mode, water flows at atmospheric pressure from the water tank 46 to a tank-to-pump valve 78 and a check valve 82 before entering the water pump 38. Additionally or alternatively, water may flow from the external water source 50 to the water pump 38. Foam concentrate flows from the foam tank 62 through a foam concentrate valve 86 and a check valve 90 before entering a foam pump 54. Additionally or alternatively, foam concentrate may flow from the external foam source 66 to the foam pump 54. Prior to entry into the foam pump 54, the foam concentrate passes through a strainer 92. Foam concentrate flows at pressure out of the foam pump 54, through a foam concentrate flowmeter 94 and a metering valve 98. The foam concentrate supply system 30 supplies foam concentrate in a first direction 99 away from the foam tank 62, and opposite a second direction 100 that is towards the foam tank 62.

The first suppression system 10 also includes a control system 102 that receives and transmits signals to control the operation of the system. The control system 102 is in electrical communication with various components of the fire suppression system 10. For example, the flowmeter 94, the metering valve 98, the water pump 38, the foam pump 54, and the recovery pump 70 may receive and transmit data related to system operations to and from the control system 102. Prime movers powering the water pump 38, the foam pump 54, and the recovery pump 70 may be adjusted to control the operating status of the water pump 38, the foam pump 54, and the recovery pump 70. This allows for adjustment of the volumetric flow rate of both water and foam concentrate through the system 10. The flowmeter 94 may serve to indicate the amount of flow of foam concentrate out of the foam pump 54. The metering valve 98 may limit the flow of foam concentrate out of the foam pump 54. Generally, the control system 102 is also responsible for opening and closing valves during shifting between operating modes, and any other related operations.

With continued reference to FIGS. 1 and 8 and the supply mode, the illustrated foam concentrate supply line 58 supplies foam concentrate to the water supply line 42 upstream of the water pump 38. A check valve 106 inhibits water from entering the foam concentrate supply line 58. Water and foam are mixed upstream of the water pump 38, and a foam-water mixture is passed into a manifold 110, where the foam-water mixture is further homogenized. In this embodiment, there is a single manifold 110 in fluid communication with the water supply line 42 and the foam concentrate supply line 58. The foam-water mixture is distributed from the manifold 110 to various discharge outlets 114-134 of the fire suppression system 10. The foam-water mixture is passed through at least one of the discharge outlets 114-134 to eject from the manifold 110 and to be applied to a fire. The general flow of water, flow concentrate, and foam-water mixture is indicated by the dashed arrows in FIG. 8.

After the supply mode has been completed, the fire suppression system can be shifted to the recovery mode. The control system 102 may activate the shifting based on user input or other parameters. During shifting, the water pump 38 and foam pump 54 are deactivated, a vent valve 138 is opened, and a recovery valve 142 is opened. A check valve 144 inhibits backflow of fluid from the fire suppression system 10 to the surroundings through the vent valve 138. The vent valve 138 is fluidly connected with the foam concentrate supply line 58 to facilitate recovery of foam concentrate from the foam concentrate supply line 58. The vent valve 138 is in fluid communication with the surroundings of the fire suppression system 10, and introduces recovery fluid (typically air) to the foam concentrate supply line 58. The recovery valve 142 is in fluid communication between a portion of the foam concentrate supply system 30 and the foam tank 62. The recovery valve 142 permits the passage of a portion of the foam concentrate in the foam concentrate supply system 30 back to the foam tank 62 in the second direction 100.

With reference to FIGS. 1 and 9 and the recovery mode, the recovery pump 70 is activated to pump foam concentrate from a portion of the foam concentrate supply line 58 through the flow switch 146 and a check valve 150 into the foam tank 62. In the illustrated embodiment, foam concentrate is recovered from a pipe segment 101 of the foam concentrate supply line 58 from the vent valve 144 and through the strainer 92. In the illustrated recovery mode, foam concentrate is recovered from the pipe segment 101 in the second direction 100. The illustrated pipe segment 101 is located between the strainer 92 and the vent valve 138. In other embodiments, the pipe segment 101 may include other portions of the fire suppression system 10. During the recovery mode, movement of foam concentrate through the pipe segment 101 and the recovery line 74 is generally depicted by the dashed arrows in FIG. 9. At the end of the operation in the recovery mode, the flow switch 146 no longer senses concentrate flow and as a result sends a signal to the control system 102 to indicate the end of the operation in the recovery mode. Alternatively, another signal indicating the end of operation in the recovery mode may be suitable. Alternatively, manual shifting between modes may be suitable.

In response to the signal indicating the end of operation in the recovery mode, the fire suppression system 10 can be shifted from the recovery mode to the flushing mode. In shifting, the control system 102 sends signals to close the vent valve 138, close the recovery valve 142, close the foam concentrate valve 86, and deactivate the recovery pump 70. At least one of the discharge outlets 114-134 in fluid communication with the water supply system and foam concentrate supply system is opened to facilitate discharge of foam concentrate from the fire suppression system 10.

With reference to FIGS. 1 and 10, in the flushing mode, a flush valve 154 is opened, the metering valve 98 is opened, and the foam pump 54 is activated. The flush valve 154 is located in a flush line 155 between the outlet of the water pump 38 and the inlet of the foam pump 54. The opened flush valve 154 permits passage of water from the outlet of the water pump 38 to the foam concentrate supply line 58. This passage of water collects any residual foam concentrate left in a portion of the foam concentrate supply line 58 after recovery. In flushing, water discharge from downstream of the water pump 38 flows through the flush valve 154 and the strainer 92 before entering the foam pump 54. Water flows through the foam flowmeter 94, flow metering valve 98, and the check valve 106. Water then flows through the water pump 38 into the manifold 110 where it flushes with clean water through at least one of the discharge outlets 114-134. The general flow of water, flow concentrate, and foam-water mixture is indicated by the dashed arrows in FIG. 10.

Figure 2:
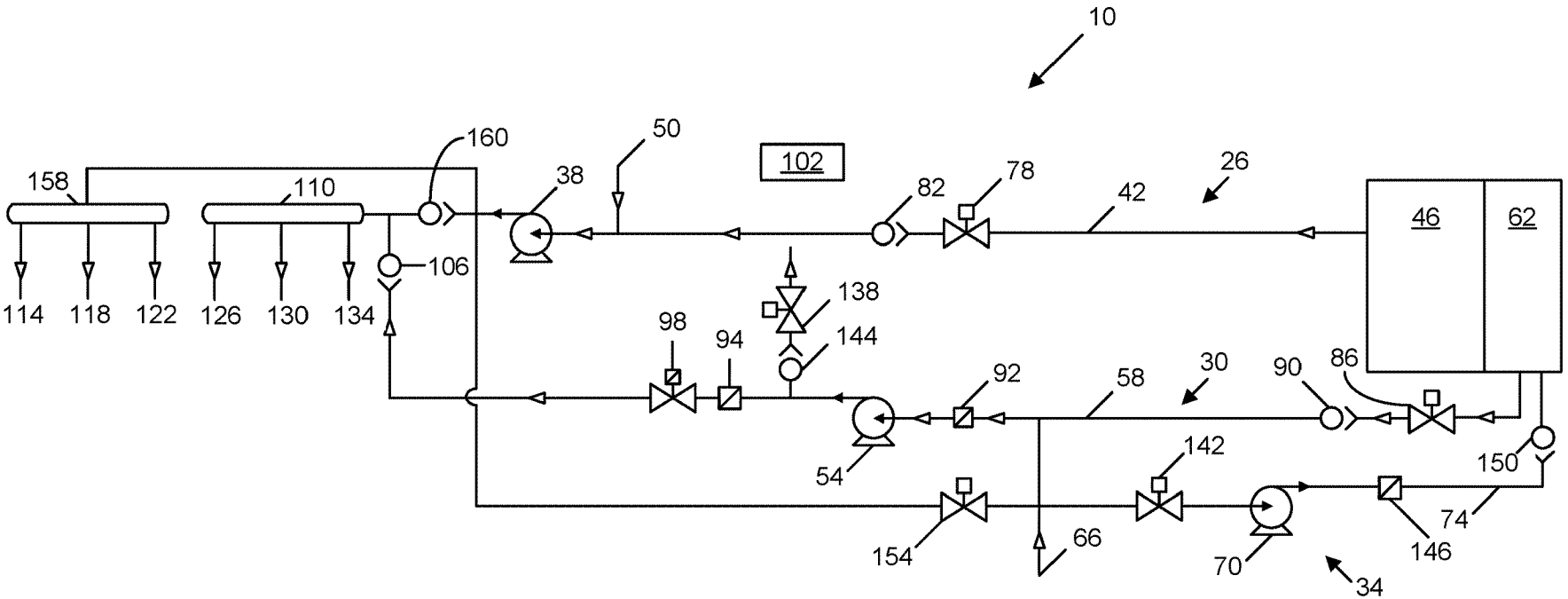
FIG. 2 is a schematic view of a second embodiment of a fire suppression system with injection of foam concentrate downstream of a water pump.

In a second embodiment illustrated in FIG. 2, the foam concentrate supply line 58 supplies foam concentrate to the water supply line 42 downstream of the water pump 38. In this configuration, pure water flows through the water pump 38. As such, the possibility of congealment of foam concentrate in the water pump 38 is mitigated. This embodiment retains the main features of the embodiment illustrated in FIG. 1. Notably, the embodiment of FIG. 2 can function in the supply mode, recovery mode, and flushing mode as in the embodiment of FIG. 1. In this embodiment, the foam-water mixture is passed into a first manifold 110, and pure water is passed into a second manifold 158. The second manifold 158 is in fluid communication with the water supply line 42, and is not in fluid communication with the foam concentrate supply line 58. As such, the fire suppression system 10 can, in the supply mode, discharge a foam-water mixture from the first manifold 110 and pure water from the second manifold 158. Optionally, the fire suppression system 10 can, in the supply mode, simultaneously discharge a foam-water mixture from the first manifold 110 and pure water from the second manifold 158. A check valve 160 inhibits backflow of the foam-water mixture towards the water supply system 26. Both the first manifold 110 and the second manifold 158 can be flushed in the flushing mode.

Figure 3:
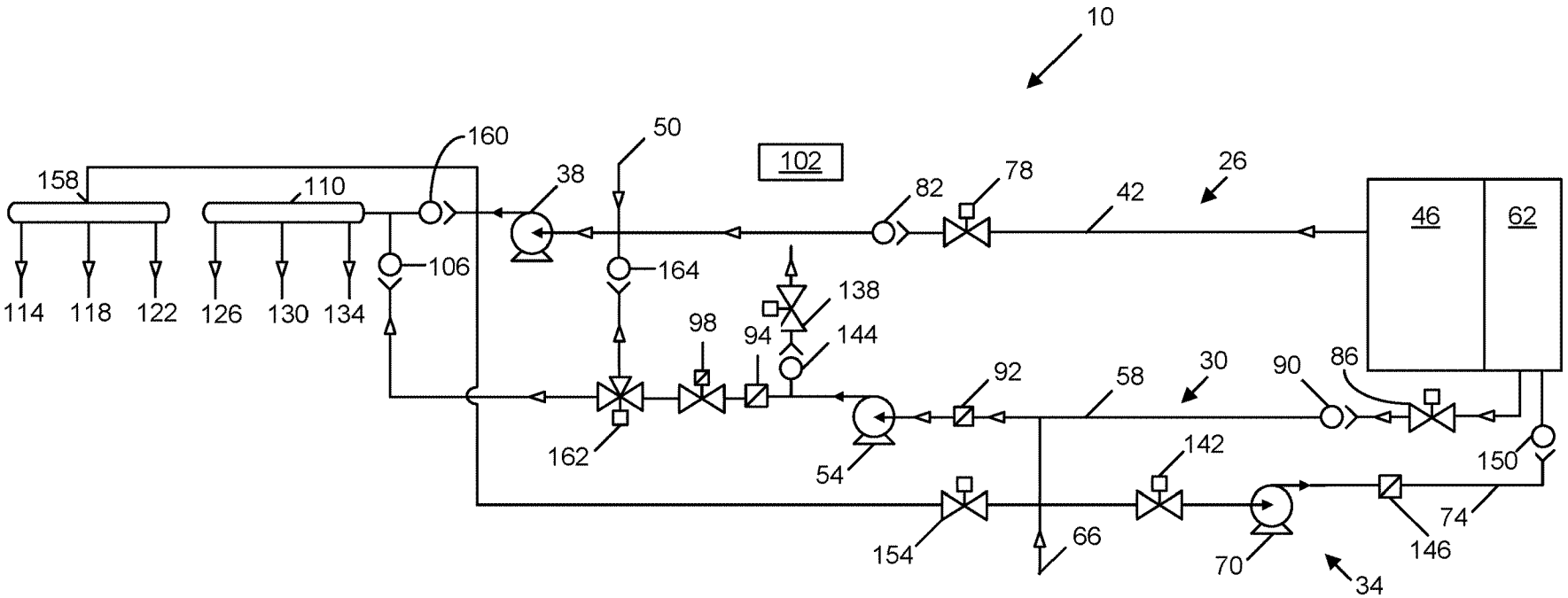
FIG. 3 is a schematic view of a third embodiment of a fire suppression system with a valve permitting injection of foam concentrate either upstream or downstream of a water pump.

In a third embodiment illustrated in FIG. 3, the foam concentrate supply line 58 includes a valve 162 capable of connecting the foam concentrate supply line 58 to the water supply line 42 upstream or downstream of the water pump 38. In the illustrated embodiment, the valve 162 is a three-way valve 162. The three-way valve 162 permits the fire suppression system 10 of FIG. 3 to function as in the fire suppression system 10 of FIG. 1 or FIG. 2 based on the operation of the three-way valve 162. In other words, the three-way valve 162 permits the foam concentrate supply line 58 to shift between a first position in which the foam concentrate supply line 58 supplies foam concentrate to the water supply system 26 upstream of the water pump 38 and a second position in which the foam concentrate supply line 58 supplies foam concentrate to the water supply system downstream of the water pump 38. A check valve 164 is positioned between the three-way valve 162 and the water supply line 26 to inhibit backflow of water into the foam concentrate supply line 58. The fire suppression system 10 of FIG. 3 can function in the supply mode, the recovery mode, and the flushing mode as in the embodiment of FIG. 1.

Figure 4:
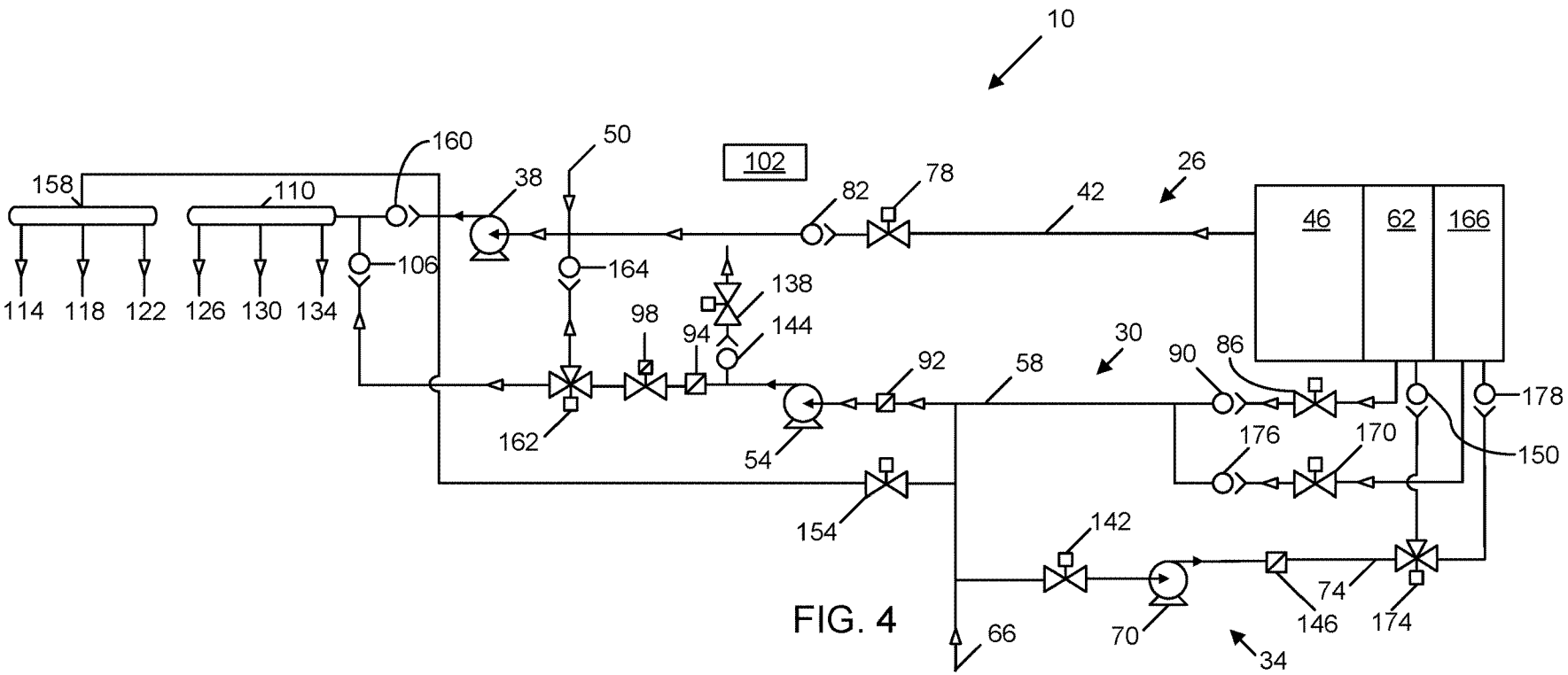
FIG. 4 is a schematic view of a fourth embodiment of a fire suppression system similar to FIG. 3 but including a first foam tank and a second foam tank.

In a fourth embodiment illustrated in FIG. 4, the fire suppression system 10 includes a first foam tank 62 and a second foam tank 166. Additional valves are also positioned in both the foam concentrate supply line 58 and the recovery line 74 such that foam concentrate can be supplied and recovered from either one of the first foam tank 62 and the second foam tank 166. As such, the foam recovery line 74 is capable of being shifted between a first position in which the recovery pump 70 extracts foam concentrate to the first tank 62 and a second position in which the recovery pump extracts foam concentrate to the second tank 166. The additional valves on the supply line may include, but are not limited to a second foam tank-to-pump valve 170 and check valve 176 inhibiting backflow of fluid into the second foam tank 166. The additional valves on the recovery line may include but are not limited to a valve 174 for selecting which tank 62, 166 foam concentrate will be recovered to, and a check valve 178 inhibiting backflow of foam concentrate towards the valve 174 from the second foam tank 166. In the illustrated embodiment, the valve 174 is a three-way valve 174 capable of recovering foam concentrate to at least one of the first foam tank 62 and second foam tank 166.

In the fourth embodiment of FIG. 4, the first foam tank 62 includes a first type of foam, for example Class A foam, and the second foam tank 166 includes a second type of foam, for example Class B foam. In such an embodiment, the fire suppression system 10 can be operated to supply and recover a given type of foam, flush the residual foam, and supply and recover the other type of foam. In other embodiments, the first foam tank 62 and the second foam tank 166 simply store the same classification of foam concentrate.

Figure 5:
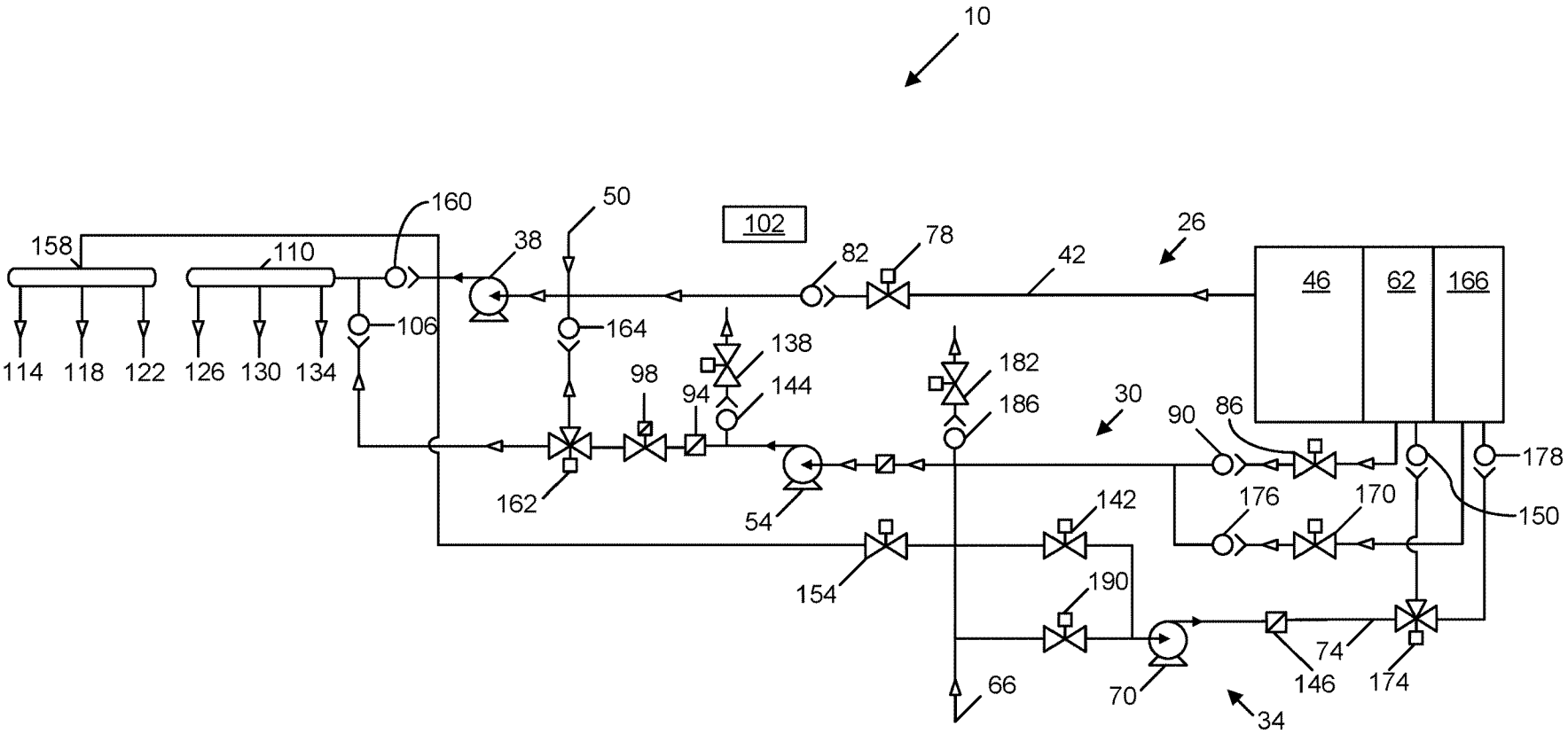
FIG. 5 is a schematic view of a fifth embodiment of a fire suppression system similar to FIG. 4 but including first and second vent valves and first and second recovery valves.

In a fifth embodiment illustrated in FIG. 5, the fire suppression system 10 includes the vent valve 138 and a second vent valve 182. The second vent valve 182 is positioned in the foam concentrate supply line 58 at a location corresponding to a different potential pressure of the foam concentrate supply line 58 as the vent valve 138. A check valve 186 is positioned between the second vent valve 182 and the foam concentrate supply line 58 to inhibit flow of fluid from the foam concentrate supply line 58 to the surroundings of the fire suppression system 10. As illustrated in FIG. 5, the vent valve 138 is at a relatively high potential pressure (i.e., downstream of the foam pump 54), and the second vent valve 182 is at a relatively low potential pressure (i.e., upstream of the foam pump 54). This permits the second vent valve 182 to introduce fluid (e.g., air) at a different potential pressure than the vent valve 138. In this embodiment, shifting the fire suppression system 10 from the supply mode to the recovery mode can include opening the second vent valve 182.

With continued reference to FIG. 5, the fire suppression system 10 further includes a second recovery valve 190. The second recovery valve 190 is positioned in the recovery line 74 at a location corresponding to a different circuit of the recovery line 74 and the foam concentrate supply line 58. Foam concentrate is allowed to be recovered independently from separate sections of the foam concentrate supply line 58 and the recovery line 74. This permits the recovery valve 142 and the second recovery valve 190 to allow fluid communication between the supply line 58 and the foam recovery line 74 and one of the foam tanks 62, 166 at multiple low points along the foam concentrate supply line 58 and the recovery line 74 that do not allow drainage from the low point.

Figure 11:
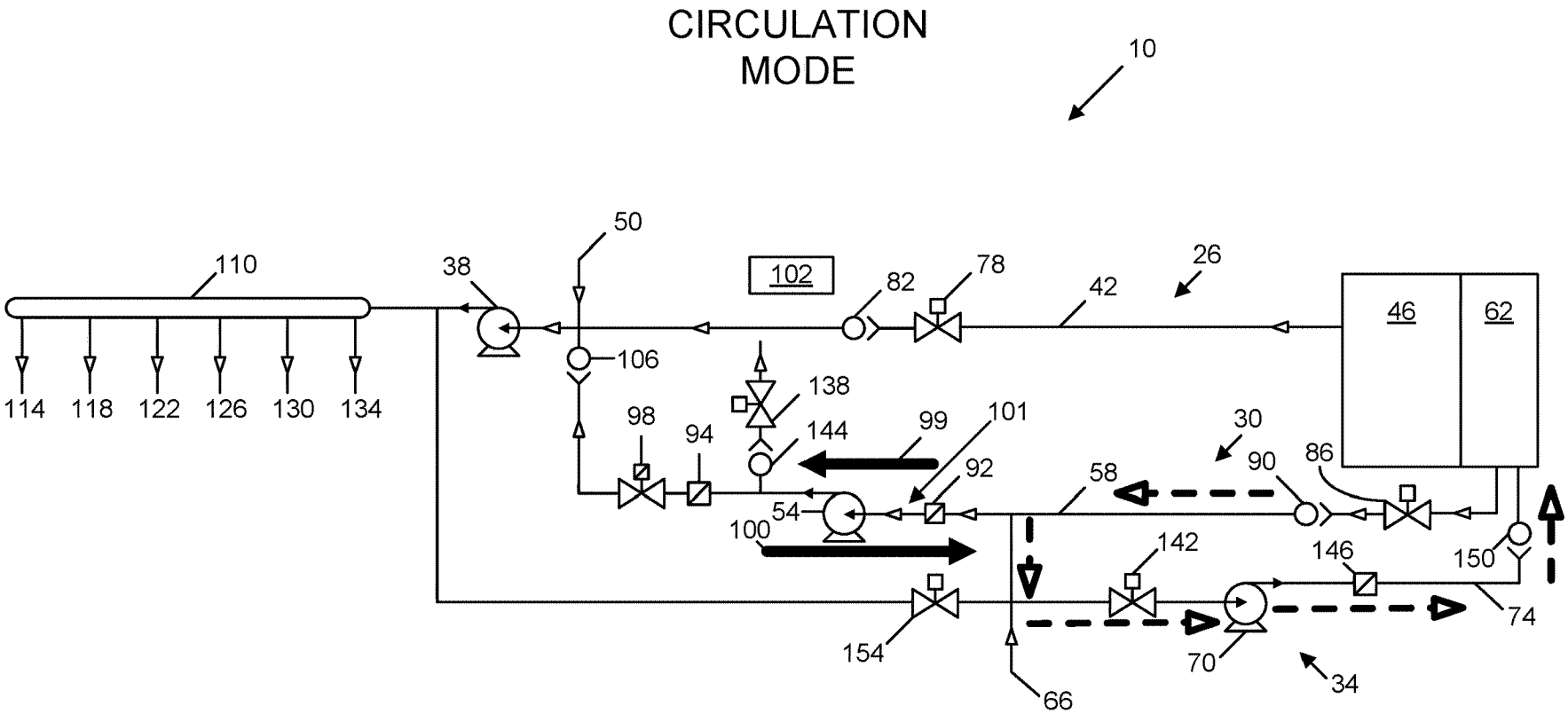
FIG. 11 is a schematic view of the fire suppression system of FIG. 1 in a circulation mode and including arrows illustrating the flow of fluid.

The fire suppression system 10 is capable of operating in a circulation mode (FIG. 11) that circulates foam concentrate to promote mixing of the foam concentrate and hinder the congealment of foam concentrate in a portion of the foam supply system and a portion of the foam recovery system. The dashed arrows in FIG. 11 indicate the flow of fluid. As a periodic maintenance measure, the recovery pump 70 is activated with the foam concentrate valve 86 and the recovery valve 142 both open and the metering valve 98 and flush valve 154 closed. Foam concentrate from the foam concentrate tank 62 flows through the foam concentrate valve 86, the check valve 90, at least a portion of the foam concentrate supply line 58, the recovery valve 142, the recovery pump 70, the flow switch 146, the recovery line 74, and the check valve 150. After passing through the check valve 150, foam concentrate is then returned to the foam tank 62. After circulating foam concentrate through the foam supply line 58 and the recovery line 74, the fire suppression system 10 can be shifted to the recovery mode as illustrated in FIG. 9 and described above, and then the flushing mode as illustrated in FIG. 10 and described above.

One or more independent features and/or advantages of the invention may be set forth in the following claims.

What is claimed is:

1. A fire suppression system comprising:

a water supply system;

a foam concentrate supply system including a pipe segment, the foam concentrate supply system fluidly connected with the water supply system to facilitate mixing of foam concentrate provided by the foam concentrate supply system and passing through the pipe segment with water provided by the water supply system; and a foam concentrate recovery system including a recovery pump fluidly connectable with the pipe segment of the foam concentrate supply system to facilitate the extraction of foam concentrate from at least a portion of the foam concentrate supply system through the pipe segment, wherein the foam concentrate supply system further comprises a foam pump in communication with the pipe segment, the foam pump configured to draw the foam concentrate from a foam concentrate source and supply the foam concentrate to the water supply system to facilitate mixing of the foam concentrate with water provided by the water supply system, and wherein the foam concentrate recovery system further includes a flow switch configured to sense when foam concentrate is no longer flowing through the foam concentrate recovery system and to deactivate the recovery pump such that recovery fluid is not introduced into the foam concentration source.

2. The fire suppression system of claim 1, wherein the foam concentrate supply system supplies foam concentrate to the water supply system upstream of a water pump.

3. The fire suppression system of claim 1, wherein the foam concentrate supply system supplies foam concentrate to the water supply system downstream of a water pump.

4. The fire suppression system of claim 1, wherein the foam concentrate supply system is operable to shift between a first position in which the foam concentrate supply system supplies foam concentrate to the water supply system upstream of a water pump and a second position in which the foam concentrate supply system supplies foam concentrate to the water supply system downstream of a water pump.

5. The fire suppression system of claim 1, wherein the foam concentrate supply system is capable of being shifted between a first position in which a first supply of foam concentrate is supplied and a second position in which a second supply of foam concentrate is supplied.

6. The fire suppression system of claim 1, wherein the foam concentrate recovery system further comprises a recovery line operable to shift between a first position in which the recovery pump extracts foam concentrate to a first tank and a second position in which the recovery pump extracts foam concentrate to a second tank.

7. The fire suppression system of claim 1, wherein the foam concentrate supply system supplies foam concentrate in a first direction through the pipe segment and the foam concentrate recovery system recovers foam concentrate in a second direction through the pipe segment, the first direction opposite the second direction.

8. The fire suppression system of claim 1, wherein the foam concentrate supply system further comprises a vent valve fluidly connected with the foam concentrate supply system to facilitate recovery of foam concentrate.

9. The fire suppression system of claim 1, wherein the foam concentrate source includes a foam tank, and wherein the water supply system is in fluid communication with a water tank and the foam concentrate recovery system is in fluid communication with the foam tank.

10. The fire suppression system of claim 9, further comprising a foam concentrate circulation mode that facilitates circulation of foam concentrate from the foam tank, through a portion of the foam concentrate supply system, through a portion of the foam concentrate recovery system, and back to the foam tank.

11. A method of operating a fire suppression system comprising:

suppling water through a water supply system;

supplying foam concentrate through a foam concentrate supply system including a foam concentrate source and a pipe segment in fluid communication with the water supply system;

mixing the water and the foam concentrate to form a foam-water mixture;

exhausting the foam-water mixture from the fire suppression system;

recovering, via a recovery pump fluidly connectable with the pipe segment, at least a portion of the foam concentrate through the pipe segment to the foam concentrate source; and prior to recovering, opening a recovery valve in fluid communication with the foam concentrate system, the recovery valve permitting passage of foam concentrate from the foam concentrate system to the foam concentrate source, wherein supplying and mixing includes drawing, from a foam pump in communication with the foam concentrate supply line, the foam concentrate from the foam concentrate source and supplying the foam concentrate to the water supply system to facilitate mixing of the foam concentrate with water provided by the water supply system, and wherein recovering includes introducing recovery fluid into the foam concentrate supply line through a vent valve in fluid communication with the foam concentrate system, the vent valve positioned on an outlet side of the foam pump and in fluid communication with an area surrounding the fire suppression system.

12. The method of claim 11, further comprising:

flushing at least a portion of the foam concentrate supply system by passing water through the water supply system and at least a portion of the foam concentrate supply system to facilitate flushing of foam concentrate from at least a portion of the foam concentrate supply system.

13. The method of claim 11, further comprising, prior to recovering, opening the vent valve to facilitate introduction of recovery fluid and recovery of foam concentrate.

14. The first suppression system of claim 1, wherein the recovery pump is in fluid communication with the pipe segment on an inlet side of the foam pump.

15. The fire suppression system of claim 1, wherein the foam concentrate supply system further comprises a vent valve positioned on an outlet side of the foam pump and in fluid communication with an area surrounding the fire suppression system, the vent valve configured to introduce recovery fluid into the foam concentrate supply system, and the foam concentrate recovery system further comprises a recovery valve that is in fluid communication with the foam concentrate supply system and the foam concentrate source.

16. The fire suppression system of claim 8, wherein the foam concentrate recovery system further comprises a recovery vent valve in fluid communication with the foam concentrate supply system and the foam concentrate source.

17. A fire suppression system comprising:

a water supply system;

a foam concentrate supply system including a pipe segment, the foam concentrate supply system fluidly connected with the water supply system to facilitate mixing of foam concentrate provided by the foam concentrate supply system and passing through the pipe segment with water provided by the water supply system; and a foam concentrate recovery system including a recovery pump fluidly connectable with the pipe segment of the foam concentrate supply system to facilitate the extraction of foam concentrate from at least a portion of the foam concentrate supply system through the pipe segment, wherein the foam concentrate supply system further comprises a foam pump in communication with the pipe segment, the foam pump configured to draw the foam concentrate from a foam concentrate source and supply the foam concentrate to the water supply system to facilitate mixing of the foam concentrate with water provided by the water supply system, and wherein the foam concentrate supply system further comprises a vent valve positioned on an outlet side of the foam pump and in fluid communication with an area surrounding the fire suppression system, the vent valve configured to introduce recovery fluid into the foam concentrate supply system, and wherein the foam concentrate recovery system further comprises a recovery valve that is in fluid communication with the foam concentrate supply system and the foam concentrate source.

18. The fire suppression system of claim 17, further comprising a foam concentrate circulation mode that facilitates circulation of foam concentrate from the foam concentrate source, through a portion of the foam concentrate supply system, through a portion of the foam concentrate recovery system, and back to the foam concentrate source.

19. The first suppression system of claim 17, wherein the recovery pump is in fluid communication with the pipe segment on an inlet side of the foam pump.

20. The fire suppression system of claim 17, wherein the foam concentrate supply system supplies foam concentrate in a first direction through the pipe segment and the foam concentrate recovery system recovers foam concentrate in a second direction through the pipe segment, the first direction opposite the second direction.

* * * * *